US006200456B1

(12) United States Patent
Harrar et al.

(10) Patent No.: US 6,200,456 B1
(45) Date of Patent: Mar. 13, 2001

(54) LARGE-SCALE PRODUCTION OF ANHYDROUS NITRIC ACID AND NITRIC ACID SOLUTIONS OF DINITROGEN PENTOXIDE

(75) Inventors: Jackson E. Harrar, Castro Valley; Roland Quong, Oakland; Lester P. Rigdon, Livermore; Raymond R. McGuire, Brentwood, all of CA (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 07/050,168

(22) Filed: Apr. 13, 1987

(51) Int. Cl.[7] ..... C25B 1/22
(52) U.S. Cl. ..... 205/553
(58) Field of Search ..... 204/103; 205/553

(56) References Cited

U.S. PATENT DOCUMENTS

| | | | | |
|---|---|---|---|---|
| Re. 34,801 | * | 11/1994 | Marshall et al. | 205/553 |
| 3,939,148 | * | 2/1976 | Siele et al. | 540/475 |
| 4,432,902 | * | 2/1984 | McGuire et al. | 204/262 |
| 4,443,308 | * | 4/1984 | Coon et al. | 204/103 |
| 4,472,255 | * | 9/1984 | Millington | 204/255 |
| 4,525,252 | * | 6/1985 | McGuire et al. | 204/103 |
| 5,181,996 | * | 1/1993 | Bagg | 205/553 |

FOREIGN PATENT DOCUMENTS

| | | | |
|---|---|---|---|
| 231546 | * | 7/1910 | (DE) . |
| 2098238 | * | 11/1982 | (GB) . |
| 1059023 | * | 8/1981 | (SU) . |
| 1089172 | * | 3/1982 | (SU) . |

OTHER PUBLICATIONS

Harrar et al, *J. Electrochem. Soc.*, 130 (1), 108 (1983).*
Zawardski et al., *Rozniki Chemii*, 22, 233–47 (1948).*
Schofield, "Aromatic Nitration", pp, 73–76, Cambridge Univ. Press (1980).*

* cited by examiner

*Primary Examiner*—Edward A. Miller
(74) *Attorney, Agent, or Firm*—L. E. Carnahan; Roger S. Gaither; Paul A. Gottlieb

(57) ABSTRACT

A method and apparatus are disclosed for a large scale, electrochemical production of anhydrous nitric acid and $N_2O_5$. The method includes oxidizing a solution of $N_2O_4$/aqueous-$HNO_3$ at the anode, while reducing aqueous $HNO_3$ at the cathode, in a flow electrolyzer constructed of special materials. $N_2O_4$ is produced at the cathode and may be separated and recycled as a feedstock for use in the anolyte. The process is controlled by regulating the electrolysis current until the desired products are obtained. The chemical compositions of the anolyte and catholyte are monitored by measurement of the solution density and the concentrations of $N_2O_4$.

8 Claims, 5 Drawing Sheets

LARGE-SCALE PRODUCTION OF ANHYDROUS NITRIC ACID AND NITRIC ACID SOLUTIONS OF DINITROGEN PENTOXIDE

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The present invention relates generally to the large scale production of anhydrous nitric acid and nitric acid solutions of dinitrogen pentoxide and more particularly to an electrolytic method and apparatus for simultaneously synthesizing water-free nitric acid and solutions of dinitrogen pentoxide in anhydrous nitric acid.

Nitric acid has become a major industrial chemical, with diverse applications and large scale industrial use in the manufacture of fertilizers, organic chemicals, explosives and the like. Generally, for most industrial and other applications, aqueous nitric acid is produced at a concentration of 50–70 wt. % $HNO_3$ by a standard ammonia oxidation process. In this process, ammonia is oxidized with excess oxygen over a catalyst to form nitric oxide and water. The nitric oxide is then oxidized to nitrogen dioxide, which is absorbed in water to form nitric acid and additional nitric oxide. The nitric acid is then concentrated, but since $HNO_3$ forms an azeotrope with water at 68.8 wt. %, it cannot be separated from the water or concentrated beyond approximately 70 wt. % by simple distillation.

While the commonly available 70 wt. % $HNO_3$ is suitable for the production of ammonium nitrate fertilizer and many other inorganic chemicals, more highly concentrated or completely anhydrous (water-free) nitric acid is required for use in many organic nitrations. Mixtures of nitric and sulfuric acids are also commonly used for organic nitrations, to insure a low water concentration which is favorable for these reactions. The rocket-fuel and semiconductor industries employ red fuming nitric acid, which typically consists of 15 wt. % dinitrogen tetroxide ($N_2O_4$), 2 wt. % $H_2O$, and 83 wt. % $HNO_3$.

Highly concentrated nitric acids are widely employed in the explosives industry. The prior known Bachman process, used commercially in the U.S. for the production of cyclonite (1-3-5-trinitro-1,3,5,-triazine or commonly known as RDX) and HMX (1,3,5,7-tetranitro-1,3,5,7-tetraazacyclooctane), involves a continuous nitration of hexamethylenetetramine by reaction with strong nitric acid, ammonium nitrate, and acetic anhydride. In England, RDX is manufactured by the Woolwich process in which hexamethylenetetramine is reacted with anhydrous nitric acid.

Anhydrous nitric acid, e.g., 98 to 100 wt. % $HNO_3$, has been synthesized by distillation of a weaker aqueous solution of nitric acid with sulfuric acid, the latter serving as a dehydrating agent. Typically, 60 wt. % $HNO_3$ is mixed with 93 wt. % $H_2SO_4$ in a packed tower which is provided with a steam heated reboiler. The nitric acid vapor is distilled and condensed, and the sulfuric acid and water leave the bottom as approximately 70 wt. % $H_2SO_4$. Water is then removed from the sulfuric acid in a sulfuric acid concentrator, and the 93 wt. % $H_2SO_4$ is recycled in the process. An alternative extraction medium is a 72 wt. % solution of magnesium nitrate in water. In this process, which is used in conjunction with the U.S. manufacture of RDX and HMX, the nitrate solution typically leaves the distillation column at approximately 68 wt. %, and is reconcentrated by flashing to a steam heated vacuum drum.

These methods for producing anhydrous $HNO_3$ require the recycling of large quantities of sulfuric acid or magnesium nitrate. This inherently presents the potential of major catastrophic accidents, as well as the production of large quantities of waste heat and energy. Thus from a cost standpoint, these processes are inherently deficient.

When water is further removed from anhydrous nitric acid, the anhydride of nitric acid, dinitrogen pentoxide ($N_2O_5$), is formed as represented by the equation:

$$2HNO_3 \rightarrow N_2O_5 + H_2O \quad (1)$$

Thus solutions of $N_2O_5$ in $HNO_3$ can be prepared which can be thought of as greater than 100% $HNO_3$, and which have unique properties for some chemical syntheses.

A number of organic nitration and nitrolysis reactions have been found to proceed faster, more efficiently, and in highest yield by the use of solutions of $N_2O_5$ in $HNO_3$. The high explosive HMX can be prepared by the reaction of a series of 1,3,5,7-tetra-azacyclooctanes with $N_2O_5$, formed in the reaction mixture in-situ by dehydration of the nitric acid. The dehydration is accomplished by reagents such as phosphorus pentoxide ($P_2O_5$), polyphosphoric acid, trifluoroacetic acid anhydride, or sulfur trioxide ($SO_3$). Pure $N_2O_5$ can also be synthesized by oxidation of $N_2O_4$ with ozone. In a carbon tetrachloride medium, $N_2O_5$ converts aliphatic secondary amines into nitramines in excellent yield. These reactions have never achieved large-scale use because of the high cost of producing $N_2O_5$, either by chemical dehydration or by ozonolysis. Chemical dehydration requires expensive recycling processes, and ozonolysis is electrically inefficient.

A third general approach to the synthesis of nitric-acid solutions of $N_2O_5$ is direct electrochemical oxidation of a suitable precursor compound.

The basic reaction, the oxidation of $N_2O_4$ in $HNO_3$ at a platinum anode in an electrolysis cell divided by a diaphragm, was first described in German Patent No. 231, 546, J. Zawadski and Z. Bankowski, *Roznicki Chemii.* 22 (1948), 233, extended this work, employing the same reaction and essentially the same type of apparatus, a laboratory size, stirred electrolysis cell. The anode comprised a platinum sheet, the cathode was made of sheet lead, and the diaphragm employed was a porous ceramic. In this method also, the cell voltage was controlled, and $N_2O_5$ was produced with a current efficiency of 35% and a specific energy of 5 kWH/kg.

The electrolysis reaction that produces $N_2O_5$ can be written as follows:

$$N_2O_4 + 2HNO_3 \rightarrow 2N_2O_5 + 2H^+ + 2e^- \quad (2)$$

If there is water in the nitric acid at the beginning of the electrolysis, it is be consumed by the reaction:

$$H_2O+N_2O_5 \rightarrow 2HNO_3 \quad (3)$$

At a certain point in time during the electrolysis, when all of the water has been consumed, the anolyte consists solely of $HNO_3$ (anhydrous) and unreacted $N_2O_4$. From that point on, excess $N_2O_5$ is generated. Eventually all of the $N_2O_4$ is consumed by electrolysis, and the anolyte will then consist solely of $HNO_3$ and $N_2O_5$. If desired, the $N_2O_5/HNO_3$ solution can be reacted with an aqueous nitric acid solution in the correct stoichiometric amount to yield pure, anhydrous $HNO_3$.

In addition to Reaction 2, $N_2O_5$ can also be formed by the electrolytic oxidation of $HNO_3$ according to the reaction:

$$2HNO_3 \rightarrow N_2O_5+2H++(½)O_2+2e^- \quad (4)$$

The oxidation of $HNO_3$ proceeds at a higher anode potential than Reaction 1 and may proceed concurrently with Reaction 1, if the anode potential is in a region where both can occur. Although Reaction 4 produces $N_2O_5$, it also produces oxygen as a byproduct and the current efficiency for the production of $N_2O_5$ is lower.

The current efficiency for $N_2O_5$ production and yield based on the use of $N_2O_4$ could be substantially improved compared to that obtained by Zawadski and Bankowski by performing the electrolysis in a controlled-potential electrolysis cell, and controlling the anode potential to minimize the extent of the oxidation of $HNO_3$ (Reaction 4). See U.S. Pat. Nos. 4,432,902, 4,443,308 and 4,525,252. With the apparatus and methodology described in the aforementioned U.S. Patents, using a laboratory-size divided cell having a porous-glass membrane and a platinum-wire anode and cathode, a current efficiency of approximately 65% and a chemical yield of about 50% were achieved.

That anhydrous $HNO_3$ can be produced by the electrolytic reactions described above, is also disclosed by USSR Patents Nos. 1,059,023A and 1,089,172A, but there is no discussion of the preparation of $N_2O_5/HNO_3$ solutions per se in these patents. In the work described in the '023A patent, the oxidation of aqueous $HNO_3$ was carried out according to Reaction 4 until anhydrous $HNO_3$ is produced. In the work described in the '172A patent, $N_2O_4$ was included in the aqueous nitric acid solution, and it was shown, as discussed earlier, that its oxidation increased the current efficiency of the process, because the contribution of Reaction 4 to the consumption of the current is reduced.

In carrying out the aforementioned reactions, a laboratory-size divided cell, with a ceramic diaphragm and a stainless steel cathode were used, but the anode potential was not controlled. Anode materials tested were platinum, glassy carbon, and metal-oxides on a titanium substrate. These oxides were $RuO_2$, $PbO_2$, $MnO_2$, and $Co_2O_3$.

The prior art cited above, relating to the production of $N_2O_5/HNO_3$, has demonstrated the basic principles of the reactions and their feasibility on a laboratory scale, but none of the teachings has demonstrated how the electrochemical synthesis can be carried out on a large-scale, using the type of technology which would be suitable on an industrial, production scale.

Some of the problems encountered in translating the findings of laboratory experiments to large industrial scale production are summarized hereinbelow.

The electrolysis cells described in the prior art are stirred-reactors of less than 500-mL solution capacity. The removal of ohmic heat from the electrolyte is required during the electrolysis, and this cannot be done simply or efficiently with large stirred reactors without considerable design alterations.

The electrolysis cell container and diaphragm materials used in the laboratory are generally made of glass or ceramic. The fragility of these materials precludes their use as construction and diaphragm materials on a large scale basis. The extremely corrosive nature of the solutions used in this large scale process also severely limits the choices of compatible materials.

Noble-metal or noble-metal-oxide electrodes are best suited for use as the cell anode in these laboratory size experiments. However, because of the capital costs involved in their use, these materials can be used on a large scale only in the form of coatings, which, for the large scale production process remain largely untested.

Finally, electrolysis by the technique of controlling a 3-electrode controlled-potential is not practiced on a large scale because of the difficulty in the maintenance of the reference electrode and the lack of high-power automatic potentiostats. A different approach to supplying power to the electrolysis and potential control is required.

There is also no teaching in the prior art of suitable methods for on-line, real time, chemical analysis of the solutions during the electrolysis, especially methods for the measurement of the concentrations of $N_2O_4$ and $N_2O_5$, which are required for large-scale implementation of the basic process. In particular, the concentrations of both $N_2O_4$ and $N_2O_5$ must be known in order to control the proportions of the product solution for subsequent organic syntheses or for the preparation of anhydrous $HNO_3$.

There is also no teaching in the prior art of any large-scale, electrolytic preparation of anhydrous $HNO_3$ and $N_2O_5/HNO_3$, nor on the concurrent production of $N_2O_4$ by the cathode in the same electrolyzer or electrolysis cell. In an electrolysis cell for the preparation of $N_2O_5$, the initial catholyte solution is generally either nearly-anhydrous nitric acid or aqueous nitric acid. The cathode reaction can be written as:

$$2HNO_3+2H^++2e^- \rightarrow N_2O_4+2H_2O \quad (5)$$

This reaction, in combination with Reaction (2) yields the net electrolysis-cell reaction, which is the same as Reaction (1), the dehydration of nitric acid. Thus in a perfectly operating electrolysis cell, the quantity of $N_2O_4$ generated at the cathode would be exactly balanced by the quantity consumed at the anode. The $N_2O_4$ generated in the catholyte could be recycled as a feedstock or as a makeup for the $N_2O_4$ consumed in the anolyte, if a suitable method could be developed therefor. Recovery of the catholyte $N_2O_4$ is essential for the economic operation of the process on a large scale. Flow electrolyzers with electrolyte recirculation through heat exchangers would be the design of choice for large-scale electrosynthesis.

It would be desirable, therefore, to have available, an economical method for the production of $N_2O_5$ on a large scale, particularly in view of the fact that the selection of materials for the electrode coatings, the cell separator, and the cell frames, the methods of solution handling, and the techniques of chemical monitoring are critical to a realization of the scale-up for $N_2O_5$ and $HNO_3$ synthesis.

Accordingly, an object of the present invention is the large-scale, electrolytic production of anhydrous nitric acid.

Another object is the large-scale production of solutions of $N_2O_5$ in $HNO_3$.

Yet another object of the invention is an apparatus and methodology for the large scale production of anhydrous nitric acid and solutions of $N_2O_5$ in $HNO_3$.

Still another object is the recovery of the $N_2O_4$ produced in the catholyte.

A further object of the invention is the recycling of the $N_2O_4$ generated in the catholyte as a feedstock for the anolyte.

Still another object is to provide a method for monitoring the composition of the solutions during production.

Another object is the use of a plate-and-frame, flow through, divided-cell type electrolyzer With electrodes of aluminum coated with $IrO_2$ and niobium coated with Pt or Pt-Ir, and ion-exchange or porous separators, for the production of $N_2O_5/HNO_3$.

Another object is a method for monitoring the composition of the solutions during production.

Additional objects, advantages and novel features of the invention, together with additional features contributing thereto and advantages accruing therefrom will be apparent to those skilled in the art, from the following description of the invention which is shown in the accompanying drawings which are incorporated herein by reference thereto and form an integral part hereof. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention as broadly described herein, the subject invention is directed to a method and apparatus for the large-scale, electrolytic production of anhydrous nitric acid and solutions of dinitrogen pentoxide in nitric acid. Basically, the method comprises providing a plate-and-frame, flow through, divided-cell type electrolyzer, said electrolyzer being provided with an anode disposed in an anode compartment and a cathode disposed in a cathode compartment, the anode and the cathode compartments being separated by a plurality of separators, placing an aqueous solution of $N_2O_4$ or a solution of $N_2O_4$ in anhydrous or aqueous nitric acid in the anode compartment, placing aqueous or anhydrous nitric acid in the cathode compartment, applying a constant step-wise controlled current flow through the electrolyzer, vacuum distilling anhydrous $N_2O_4$ formed in the catholyte, recycling the $N_2O_4$ through the anode compartment as feed stock for the anode, and collecting anhydrous nitric acid and $N_2O_5$ formed in the anode compartment. More specifically, the method includes providing a plate-and-frame, flow-through, divided-cell type electrolyzer, with electrodes constructed out of a layer of a suitable catalytic substance deposited on a suitable metal substrate. Exemplary electrode materials include but are not limited to iridium dioxide ($IrO_2$) coated on aluminum (Al) and platinum (Pt) or platinum-iridium on niobium (Nb) or aluminum and with cell separators made out of porous fluoropolymers or ion exchange materials. The solutions that are electrolyzed are contained in reservoirs of 5 to 10 gallon capacity. The solutions are pumped first through heat exchangers to chill them and then through the electrolyzer where electrolysis takes place and where the solutions become heated due to the expenditure of electrochemical energy and ohmic heating of the solution. Heat removal and solution flow rates are adjusted so that the exit temperatures of the electrolyzer solution do not exceed 22° C. (the boiling point of $N_2O_4$). Solutions exiting the electrolyzer are passed through gas/liquid separators before being returned to the reservoirs. This provides a more direct vent for entrained gases (such as anolyte oxygen), and permits smoother pressure and flow control. The solution and its constituents contained in the anode compartment is referred to herein as the anolyte and the solution and/or components contained in the cathode compartment are referred to as the catholyte.

To reiterate, the method for the production of anhydrous nitric acid and a solution of dinitrogen pentoxide in nitric acid, comprises providing a plate-and-frame, flow through, divided-cell type electrolyzer. The electrolyzer is provided with an anode disposed in an anode compartment formed by the anode, frame members and the separator, and a cathode disposed in a cathode compartment formed similarly by the cathode, the frame members and the separator. The anode and the cathode compartments are separated by one or more separators. A solution of $N_2O_4$ in aqueous or anhydrous nitric acid is placed in the anode compartment, and aqueous or anhydrous nitric acid in placed in the cathode compartment. A constant step-wise controlled current flow is then established through the electrolyzer. The anhydrous $N_2O_4$ formed in the catholyte is vacuum distilled. The $N_2O_4$ thus formed is then recycled through the anode compartment as feed stock for the anode. The anhydrous nitric acid and $N_2O_5$ formed in the anode compartment are then collected. Preferred anode coatings include $IrO_2$, followed by Pt-Ir, Engelhard Series 7000 Pt, and Engelhard 11000 Pt. Aluminum and niobium are the preferred metal substrates. The preferred cathode coating is either 7,000 Pt or Pt-Ir on a substrate of niobium.

In operation, the differential pressure across the semipermeable separator is also regulated to minimize cross-flow of the anolyte and catholyte solutions. Materials used as separators must not only be capable of preventing the cross flow of the chemicals used or produced during the electrolysis but must also be resistant to action by those chemicals. Materials suitable for use as separators include porous hydrophilic teflon, perfluorinated cation exchange membranes and perfuorinated anion exchange membranes and the like. Data from the electrolysis are gathered and analyzed by the use of a computer via an analog-to-digital converter interface. Two solution measurements are made on either the anolyte or the catholyte as required. The concentration of $N_2O_4$ is measured spectrophotometrically in a segmented-flow analyzer, for example. The solution density is measured, for example, with a high-resolution flow-through density meter. From these two measurements, and calibration data, the concentration of $N_2O_4$ and water in the catholyte and the concentration of $N_2O_4$ and water or $N_2O_5$ in the anolyte are calculated. This provides a method for monitoring the progress of the electrolysis with time.

The novel features of the invention include the use of ion exchange materials as separators for the production of nitric acid and solutions of dinitrogen pentoxide in nitric acid, the use of iridium oxide coatings on metal substrates and the continuous monitoring of the chemical compositions of the anolyte and catholyte as a measure of the progress of the reaction.

BRIEF DESCRIPTION OF THE DRAWINGS

The accompanying drawings, which are incorporated herein by reference thereto and which form a part hereof, illustrate various embodiments of the invention, and, together with the description, serve to explain the principles of the invention.

DETAILED DESCRIPTION OF THE INVENTION

Figure 1:
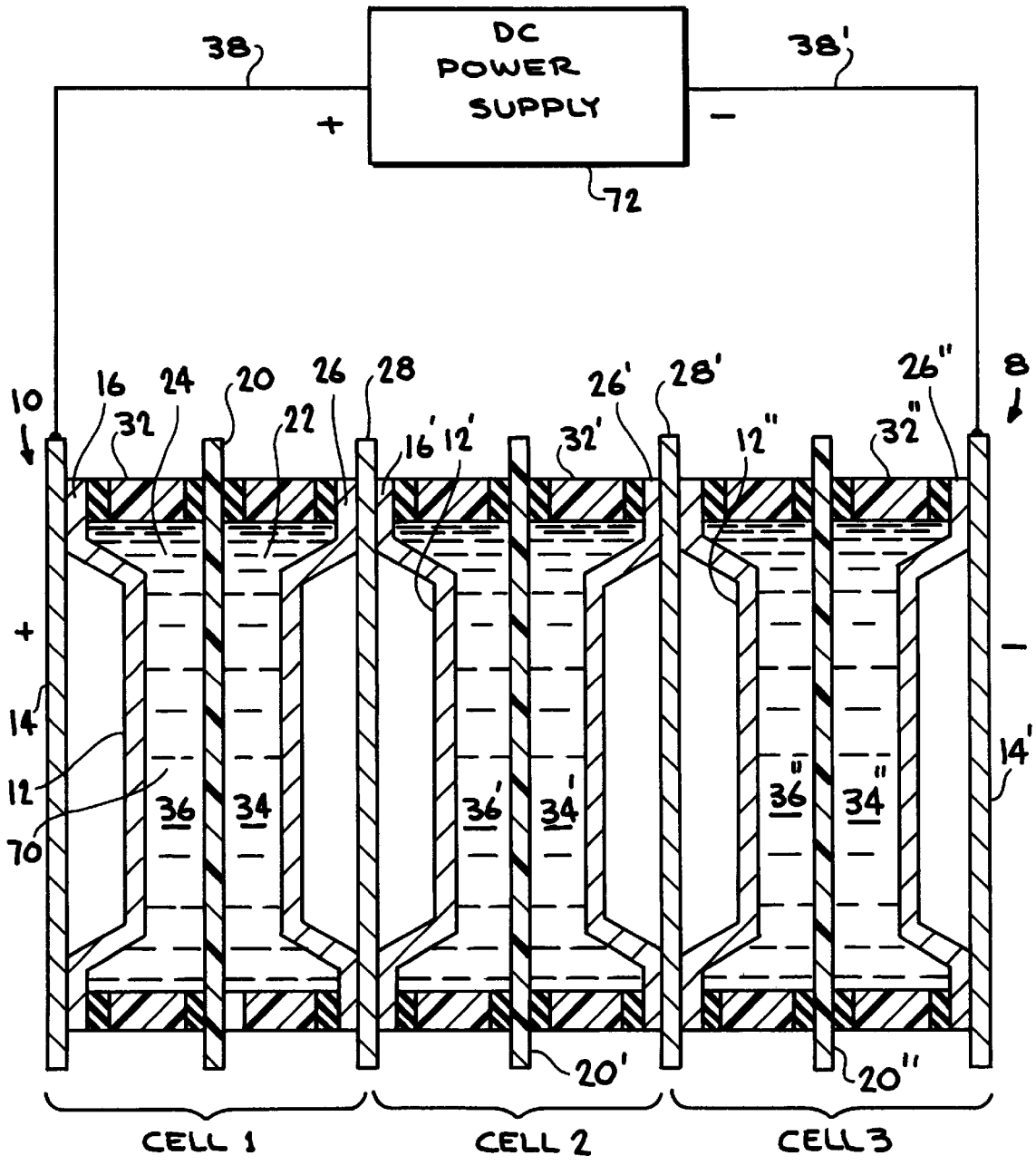
FIG. 1 is a vertical sectional view of the plate-and-frame type of electrolyzer.

The present invention is directed generally to a method and apparatus for the large-scale, economically feasible, electrolytic production of anhydrous nitric acid and solutions of dinitrogen pentoxide in nitric acid. More specifically, the method for the production of anhydrous nitric acid and a solution of dinitrogen pentoxide in nitric acid, comprises providing a plate-and-frame, flow through, divided-cell type electrolyzer, said electrolyzer being provided with an anode disposed in an anode compartment and a cathode disposed in a cathode compartment, the anode and the cathode compartments being separated by a plurality of separators, placing an aqueous solution of $N_2O_4$ or a solution of $N_2O_4$ in anhydrous nitric acid in the anode compartment, placing aqueous or anhydrous nitric acid in the cathode compartment, applying a constant step-wise controlled current flow through the electrolyzer, vacuum distilling anhydrous $N_2O_4$ formed in the catholyte, recycling the $N_2O_4$ through the anode compartment as feed stock for the anode, and collecting anhydrous nitric acid and $N_2O_5$ formed in the anode compartment. The plate-and-frame, flow through, divided-cell type electrolyzer is provided with an anode disposed in an anode compartment formed by the anode, frame members and the separator, and a cathode disposed in a cathode compartment formed similarly be the cathode, the frame members and the separator. The anode and the cathode compartments are separated by one or more separators. A solution of $N_2O_4$ in aqueous or anhydrous nitric acid is placed in the anode compartment, and aqueous or anhydrous nitric acid in placed in the cathode compartment. A constant step-wise controlled current flow is then established through the electrolyzer. The anhydrous $N_2O_4$ formed in the catholyte is vacuum distilled. The $N_2O_4$ thus formed is then recycled through the anode compartment as feed stock for the anode. The anhydrous nitric acid and $N_2O_5$ formed in the anode compartment are then collected. Electrodes used for the electrolysis are generally constructed so as to have a layer of a suitable catalytic substance deposited on a suitable metal substrate. Exemplary electrode materials include but are not limited to iridium dioxide ($IrO_2$) coated on aluminum (Al) and platinum (Pt) or platinum-iridium on niobium (Nb) or aluminum. Preferred anode coatings include $IrO_2$, Pt-Ir, Engelhard Series 7000 Pt, and Engelhard 11000 Pt and the like. Aluminum and niobium are the most preferred metal substrates. The preferred cathode coating is either 7,000 Pt or Pt-Ir on a substrate of niobium. Cell separators are made out of any suitable material that prevents cross flow of the reactant and products of the electrolysis and which is also resistant to chemical attack by the corrosive reactants and products. Exemplary separator materials include porous fluoropolymers or ion exchange materials.

The basic design of the electrolyzer used for the electrolysis is a modified version of the electrolyzer generally described in British Patent No. 2,098,238A and in U.S. Pat. No. 4,472,255.

Now, referring to the drawings, FIG. 1 is a vertical sectional view of the electrolyzer of the present invention. The electrolyzer of this invention may comprise a plurality of cells (up to a practical limit of about 20 or more) connected electrically in series, although only three cells are shown in FIG. 1. In addition to the series operation (known as bipolar), the electrolyzer can also be operated with the cells in a parallel, or monopolar arrangement. Both methods are equally suitable for use in industrial applications. In some of the examples of this invention, only two cells were used.

Now referring to FIG. 1, electrolyzer 10 comprises one or more cells 12 stacked or connected together in series or in parallel (series connection shown) and enclosed in housing means 8. Three (3) cells, marked as cell 1, cell 2, and cell 3 are shown in this embodiment. Each one of cells 12 comprises an anode 16 disposed within an anode compartment or chamber 24 and a cathode 26 dismounted posed within a cathode compartment or chamber 22 which is within a plurality of rectangular cell frame members 32 such that the edges of anode 16 and cathode 26 are sealingly engaged with frame members 32. Frame members 32 have horizontal and vertical members to support cells 12. Frame members are fabricated out of any suitable insulating material which is also resistant to the electrolysis media, such as for example, polytetrafluoroethylene (teflon), polychlorofluoroethylene, or polyvinylidene fluoride. Suitable sealing means, such as O-rings, gaskets, rectangular rings etc. may be employed to seal frame members to anode 16 and cathode 26. Seal rings or gaskets are usually made of teflon or polychlorofluoroethylene (Kel-F) elastomer. Anode 16 and cathode 26 are also separated from each other with no direct electrical contact with each other. Anode 16 of Cell 1 and cathode 26" of cell 3 are also operatively connected to a current collector plates 14 and 14' such that electrical contact is established between anode 16 and plate 14 and cathode 26" and plate 14'. Current collector plates 14 and 14' are connected by suitable cables and wiring to a direct current power supply 72. When more than one cell is used, intercell plates 28 and 28' separate each cell from the other and at the same time provides for electrical contact between one cell and the next. Current collector plates and intercell plates are made out of aluminum or any suitable conductive material that is also resistant to the nitric acid medium of the electrolysis. An electrolyte chamber 70 is defined by anode 16, cathode 26 and frame members 32. An ion-permeable separator 20 separates and divides chamber 70 into anolyte chamber or subchamber 24 and catholyte chamber or subchamber 22 to provide for the use of two different electrolytes in the anolyte and catholyte chambers. Suitable materials used in the construction of the separator include porous, hydrophilic teflon, any suitable cation exchange material such as Nafion (Dupont) or an anion exchange material such as Raipore (RAI Research). Each of subchambers 22 and 24 is provided with a least one inlet and one outlet through frame members for electrolytes 34 and 36. Electrode materials used in the present invention include iridium oxide coated on aluminum, platinum coated on niobium, platinum-iridium coated on niobium and platinum-iridium coated on aluminum. Electrode sizes used were 0.096 $m^2$ and 0.25 $m^2$. Electrodes may be concave or dish-shaped, with the chamber between the electrode and collector or intercell plates being filled with an appropriate material. The entire assembly is clamped together either by bolts at the four corners or by a gear-driven pressure plate. Means are also provided for maintaining the temperature of the electrolyzer 10 at a desired temperature and electrical potential.

If fabricated of suitable materials, an electrolyzer of the "zero-gap" type, with perforated metal electrodes would also be suitable for this process.

In operation of the electrolysis system, current flows from positive cable 38 from Power Supply 72 to current collector plate 14, through the anode 16, through the anolyte solution 36, through the semipermeable separator 20, through the catholyte solution 34, through the cathode 26, through the intercell conductor plate 28 (which is optional), and then to the anode 16' of Cell 2. The current flows, as shown in FIG. 1, in like manner, from left to right, through the entire cell system and back to the negative cable of the Power Supply. Anolyte and catholyte solutions 36 and 34 respectively, are simultaneously pumped through the cells from the bottom to the top, into and out of ports or inlets and outlets in the cell frames. The current collector plates, the anode, the electrolytes, the semipermeable membrane separator and the cathode provide a continuous electrical path for current flow through the electrolyzer.

Figure 2:
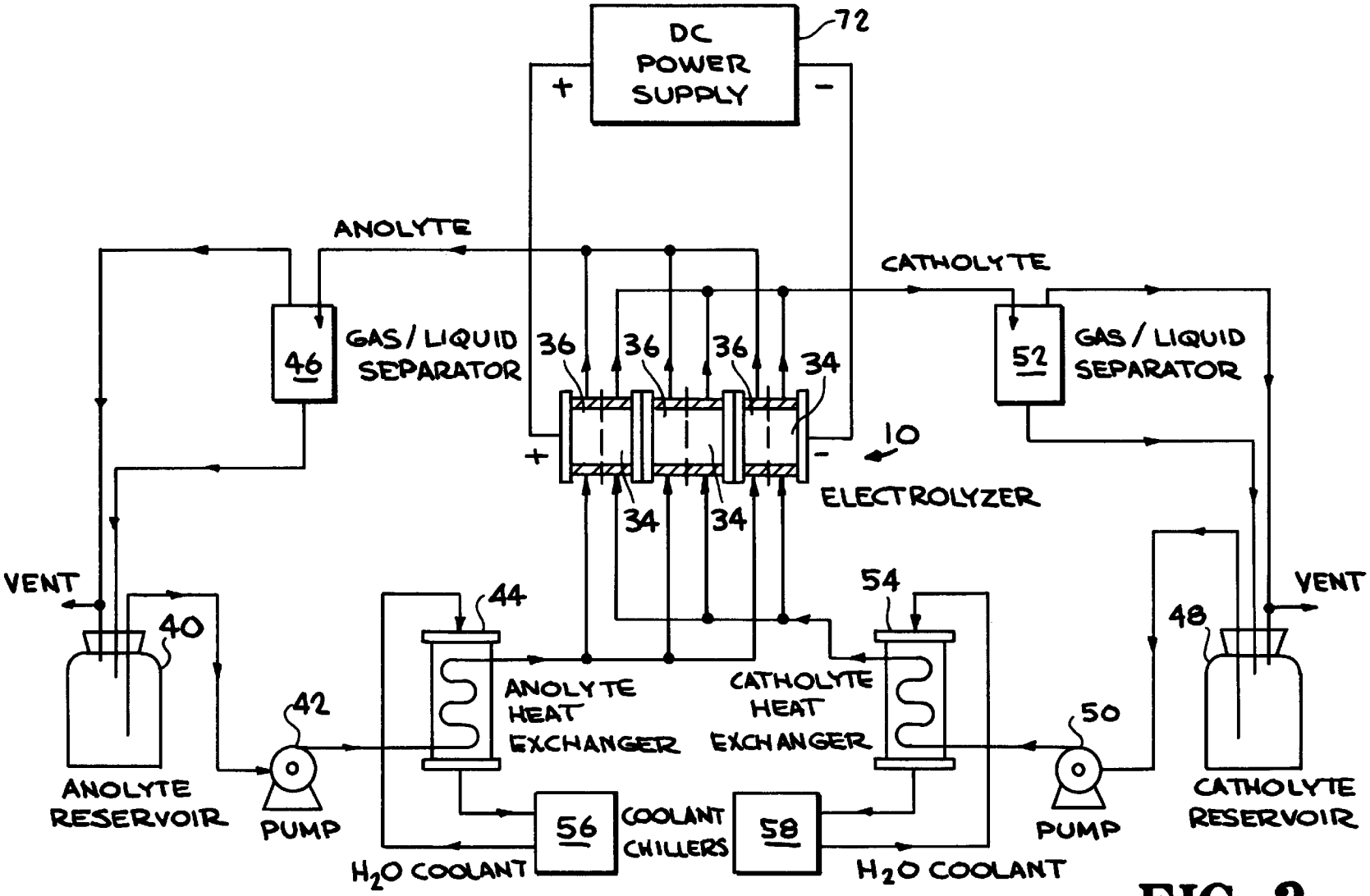
FIG. 2 is a schematic illustration of the electrolysis system.

FIG. 2 illustrates a schematic diagram of the electrolyzer system of the present invention. Electrolyzer 10 is electrically connected to D.C. Power Supply 72. Fluid communication is established between subchambers 36, 36' and 36" and anolyte reservoir 40, by means of appropriate tubing or piping, via anolyte gas/liquid separator 46, anolyte pump 42, and anolyte heat exchanger 44. Similarly, fluid communication is established between sub-chambers 34, 34' and 34" and catholyte reservoir 48 via catholyte gas/liquid separator 52, catholyte pump 50, and catholyte heat exchanger 54. Heat exchangers 44 and 54 are connected to cooling systems such as water cooling systems 56 and 58, respectively. Reservoirs 40 and 48 and heat exchangers 44 and 54 are constructed out of glass, ceramic, teflon or any suitable material that is corrosion, temperature, and acid resistant.

As shown in FIG. 2, the anolyte and catholyte fluid handling systems are identical mechanically. The major portion of a batch of solution that is electrolyzed is contained in reservoirs 40 and 48 of about 5 to 10 gallon capacity. The electrolyte solutions from reservoirs 40 and 48 are pumped by pumps 42 and 50 first through heat exchangers 44 and 54 to chill them and then through the electrolyzer 10 where electrolysis takes place and where the solutions become heated due to the expenditure of electrochemical energy and ohmic heating of the solution. Heat removal and solution flow rates are adjusted so that the exit temperatures of the electrolyzer solution do not exceed 22° C. (the boiling point of $N_2O_4$). Solutions exiting the electrolyzer 10 are passed through gas/liquid separators 46 and 52 before being returned to the reservoirs 40 and 48. This provides a more direct vent for entrained gases (Such as anolyte oxygen), and permits smoother pressure and flow control. In operation, the differential pressure across the semipermeable separators 20, 20' and 20" is also regulated to minimize cross-flow of the anolyte and catholyte solutions.

Figure 3:
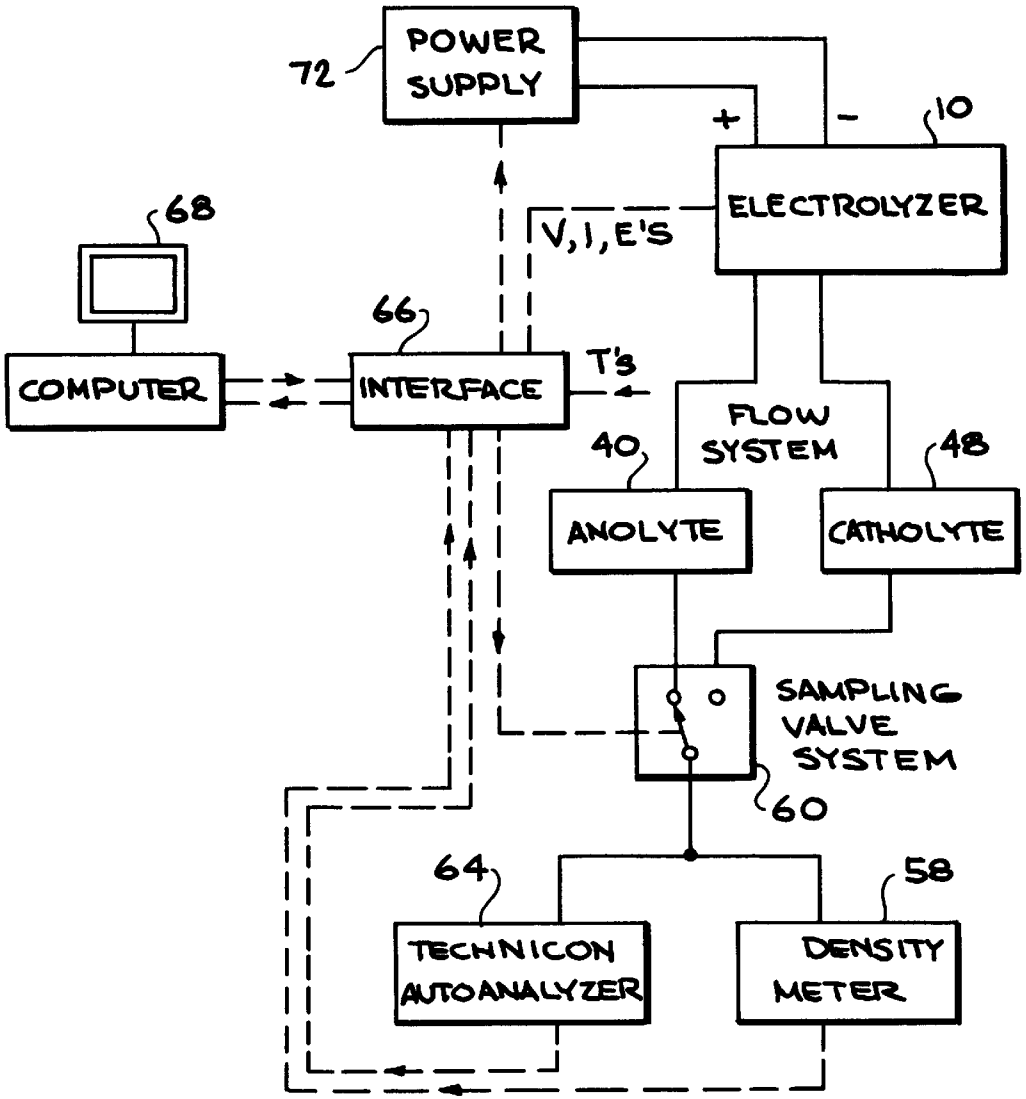
FIG. 3 is a schematic illustration of the data gathering and analytical components of the entire electrolysis system.

FIG. 3 shows a schematic diagram of the overall control and analytical chemistry subsystems. Electrolyzer 10 is in fluid communication with anolyte reservoir 40 and catholyte reservoir 48. Reservoirs 40 and 48 are also connected by means of appropriate tubing or piping to sampling valve system 60 from where it is directed to high-resolution flow-through density meter 58 for the measurement of the density of the solution and to segmented-flow analyzer 64 for spectrophotometric analysis to measure $N_2O_4$. Data from the electrolysis is acquired by a computer 68 via an analog-to-digital converter interface 66. Two solution measurements are made, on either the anolyte or the catholyte as required. From these two measurements, and calibration data, the concentration of water and $N_2O_4$ in the catholyte and the concentration of water and $N_2O_4$ or $N_2O_5$ in the anolyte are calculated. This provides a monitor on the progress of an electrolysis. Control of the process is also effected by continually measuring the system voltage, current, solution volumes and temperatures via the interface.

The following examples are presented to illustrate the electrolyzer and the method of the subject invention and are not to be construed as limiting the invention in any manner or form or to the precise form described in the examples. Table 1 lists the materials of construction of the key components of the electrolyzer and the electrolysis system used in the examples presented. The individual electrode coating and metal substrate combinations and the separator materials used in the following examples are listed in Tables 2 and 3.

TABLE 1

Materials Of Construction Of The Components For The $N_2O_5$ Process

| Component | Material |
|---|---|
| Electrolyzer Frames | TFE Teflon |
| Metal Supports | 1100 aluminum and 316 stainless steel |
| Current Collectors | 1100 aluminum |
| Intercell Plates | 1100 aluminum |
| Gaskets | Kel-F elastomer (proprietary; Industrial Electronic Rubber Co., Ohio) |
| Electrodes | see Table 2 |
| Separators | see Table 3 |
| Fluid System | |
| Piping, Tubing, Fittings | TFE and PFA Teflon |
| Valves & Pumps | TFE Teflon and Kalrez elastomers |
| Heat Exchangers | Glass |
| Gas-Liquid Separators | Glass |
| Flowmeters | Kel-F and TFE Teflon |
| Reservoirs | Glass |

TABLE 2

Electrodes for the $N_2O_5$ Process

| Coating | Tradename | Manufacturer | Substrate |
|---|---|---|---|
| $IrO_2$ | TIR-2000 | Eltech | Aluminum |
| Pt | Series 7000 | Engelhard | Niobium |
| Pt | Series 11000 | Engelhard | Niobium |
| Pt-Ir | Type N | Engelhard | Niobium |
| Pt-Ir | Type N | Engelhard | Aluminum |

TABLE 3

Separators for the $N_2O_5$ Process

| Type | Tradename | Number | Manufacturer |
|---|---|---|---|
| Porous Teflon | | 206–712 | |
| | | 206–714 | |
| | | 206–715 | ICI, Ltd; Mond Div. |
| Cation Exchange | Nafion | 117 & 324 | DuPont |
| Anion Exchange | Raipore | R-4035 | RAI Research, Inc. |

EXAMPLE 1

Production Of Anhydrous Nitric Acid And Solutions Of $N_2O_5/HNO_3$

To produce anhydrous nitric or solutions of $N_2O_5$ in $HNO_3$, the appropriate solutions were first placed in the anolyte and catholyte reservoirs. Aqueous or anhydrous nitric acid was placed in the catholyte reservoir and a solution of $N_2O_4$ in aqueous or anhydrous nitric acid was placed in the anolyte reservoir. The preferred concentration of $N_2O_4$ in the initial anolyte was 15 to 25 wt %. For the 0.1-$m^2$ electrolyzer, the anolyte and catholyte solution volumes were each 3 to 5 gal.; for the 0.25-$m^2$ electrolyzer the solution volumes were approximately 10 gallons each.

The solutions were then pumped through the electrolyzer as described above, cooled and, by increasing the dc voltage output of the power supply, the electrolysis was commenced. The electrolysis current was monitored and ramped up to a maximum value over a period of 10 to 30 minutes. For the 0.1-$m^2$ electrolyzer, the maximum current was 150 Amperes; for the 0.25-$m^2$ electrolyzer, the maximum current was 500 Amperes. The flow rates of the solutions in the recirculating loops were as follows: approx. 0.7 gal/min for the 0.1-$m^2$ electrolyzer and 3 gal/min for the 0.25-$m^2$ electrolyzer. The chiller set-point temperature and coolant flow rates were adjusted to keep the electrolyzer solution effluent temperatures below 22° C., preferably in the range of about 5° C. to 20° C.

As the electrolysis proceeded, and as the $N_2O_4$ was consumed in the anolyte, it was necessary to decrease the electrolysis current to keep Reaction 4, the direct oxidation of $HNO_3$, from occurring to a greater and greater extent. As noted above, this reaction also generates $N_2O_5$, but at reduced current efficiency; moreover, this reaction produces gaseous oxygen, which, in large amounts, causes instabilities in the fluid-handling system. Four methods were used as criteria for determining the points at which the electrolysis current was decreased:

1. Measurement of the anode potential with a reference electrode. When the potential exceeded the predetermined value at which the extent of Reaction 4 was known to be excessive, the current was decreased.
2. Measurement of anolyte gas evolution by means of a flow meter. When the rate of gas evolution indicated that a significant fraction of the current was producing oxygen, the current was decreased.
3. Visual observation of anolyte gas evolution. In manually operated electrolyses with a flow system that incorporated translucent electrolyzer exit tubing, an excessive degree of oxygen evolution can be detected and the current decreased.
4. Measurement of the concentration of $N_2O_4$ in the anolyte. When the concentration of $N_2O_4$ reached 10 to 15 wt %, the current was decreased to ⅔ of the initial value, and when the concentration reached 5 to 6 wt %, the current was decreased to 1/3 of its original value.

The criterion that was adopted for changing the current represents a tradeoff between a high rate of production of $N_2O_5$ vs. a low current efficiency and production of excessive oxygen. Methods 1, 2, and 4 could be the basis of an automatic, feedback control system that would control the reaction by manipulating the power supply voltage or current. Such regulation is necessary when anhydrous nitric acid and $N_2O_5$ are produced by the batch process. These products could also be made in a continuous electrolytic process in which a steady-state level of anolyte $N_2O_5$ is reached, solution is continuously removed, and $N_2O_4$ is continuously fed to maintain the desired $N_2O_5$ production rate. In the continuous process, the electrolysis current and electrolyzer voltage would be held constant.

Figure 4:
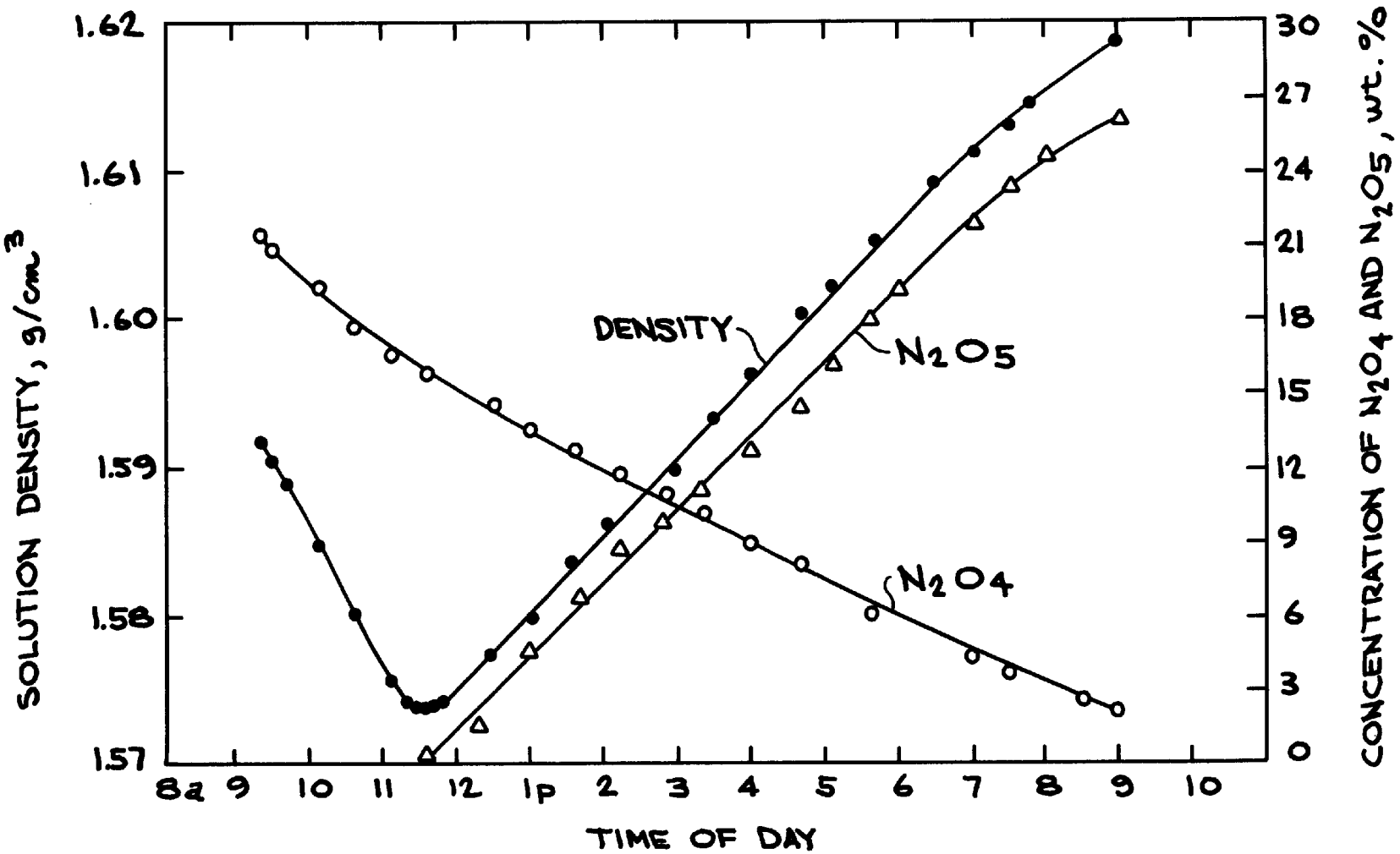
FIG. 4 is a graph showing the change in density and composition of the electrolyzer anolyte as a function of time.
Figure 5:
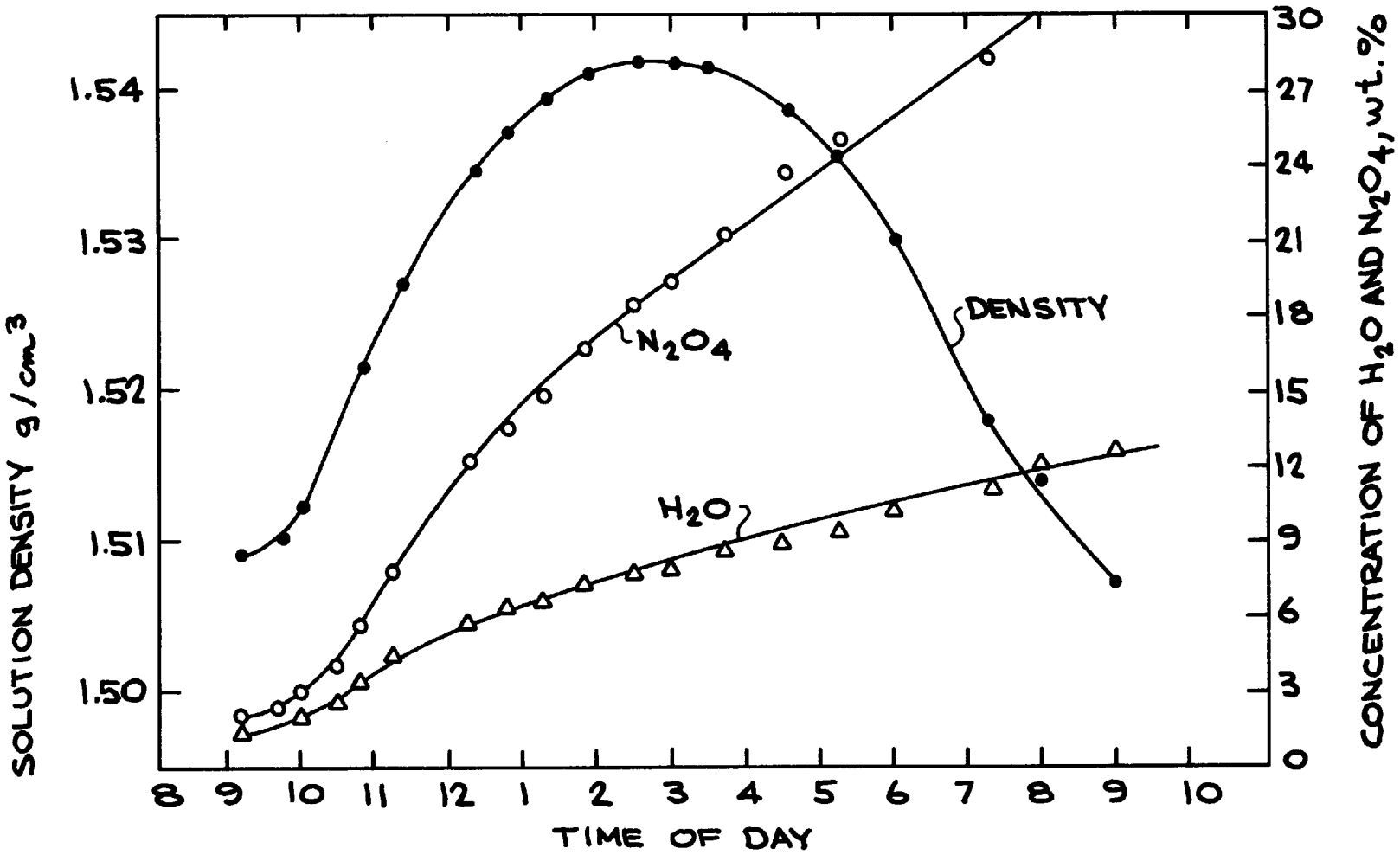
FIG. 5 is a graph showing the change in density and composition of the electrolyzer catholyte as a function of time.

In this example, commercial-grade, concentrated nitric acid was used. For electrolyses with the 0.1-$m^2$ electrolyzer, the nitric acid contained 1.1 wt % $H_2O$; for those with the 0.25-$m^2$ electrolyzer, the concentration of $H_2O$ was 1.7 wt %. The $N_2O_4$ for the anolyte was nominally 99.5% C.P. grade. The electrolyses were performed using the graded, regulated current methods described above. Both the anolyte and catholytes were chemically analyzed continually as the electrolyses proceeded. Examples of the composition of the anolyte and catholyte as a function of time are shown in FIGS. 4 and 5. As can be seen in FIG. 4, the anolyte density goes through a sharp minimum; this minimum precisely indicates the point at which all of the water in the anolyte has been consumed by the electrogenerated $N_2O_5$. After the water has been consumed, excess $N_2O_5$ is produced. In the catholyte, as shown in FIG. 5, both $N_2O_4$ and $H_2O$ increase in concentration as the electrolysis proceeds, and in this case the solution density goes through a broad maximum. The electrolysis is terminated when the concentrations of $N_2O_4$ and $N_2O_5$ in the anolyte reach the desired levels. For use in the nitrolysis of organic compounds, the concentration of $N_2O_4$ should be less than a few wt %.

After each batch electrolysis, final measurements were made on each solution, and then the electrochemical and process parameters of interest were calculated. The results of electrolyses with the 0.1-$m^2$ electrolyzer are given in Tables 4 and 5 below:

TABLE 4

Results of Electrolyses Experiments with the 0.1-$m^2$ Electrolyzer

| Run | No. of Cells | Coating/Substrate Anodes | Coating/Substrate Cathodes | $N_2O_5$ Chemical Yield, % | Current Efficiency % | n $F/N_2O_4$ | Molar Ratio[a] $N_2O_5/N_2O_4$ | Anolyte Volume Change, % | Membrane |
|---|---|---|---|---|---|---|---|---|---|
| | | | | ICI Teflon Membranes | | | | | |
| 6 | 2 | $IrO_2$/Ti | $IrO_2$/Ti | 53 | 57 | 1.6 | 1.06 | −33 | Nos. 712, 714 |
| 12 | 2 | Pt/Nb<br>Pt—Ir/Nb | Pt/Nb<br>Pt/Nb | 54 | 72 | 1.5 | 1.07 | −14 | Nos. 712, 715 |
| | | | | Nafion Cation Exchange Membrane | | | | | |
| 8 | 3 | $IrO_2$Ti(2)<br>Pt/Nb | $IrO_2$/Ti(2)<br>Pt/Nb | 31 | 68 | 0.9 | 0.63 | −44 | Type 117 |
| | | | | Raipore Anion Exchange Membranes | | | | | |
| 7 | 2 | $IrO_2$/Ti<br>Pt/Nb | $IrO_2$/Ti<br>Pt/Nb | 80 | 70 | 2.3 | 1.6 | +10 | 2-mil |
| 9 | 3 | $IrO_2$/Ti(2) | $IrO_2$/Ti(2) | 80 | 57 | 2.7 | 1.6 | +9 | 2-mil |
| 10 | 3 | $IrO_2$/Ti(2)<br>Pt/Nb | $IrO_2$/Ti(2)<br>Pt/Nb | 57 | 53 | 2.2 | 1.14 | −32 | 6–7 mil |
| 15 | 2 | $IrO_2$/Al<br>Pt/Ir/Nb | Pt/Nb<br>Pt/Nb | 83 | 66 | 2.5 | 1.66 | +16 | 6–7 mil |
| 16 | 2 | $IrO_2$/Al<br>Pt—Ir/Nb | Pt/Nb<br>Pt/Nb | 94 | 59 | 3.2 | 1.88 | +25 | 6–7 mil<br>higher loading |

[a]This is the ratio of the number of moles of $N_2O_5$ produced (including that consumed by the initial $H_2O$ in the anolyte) to the number of moles of $N_2O_4$ consumed.

TABLE 5

Results of Electrolyses Experiments with the 0.1-$m^2$ Electrolyzer (Initial Concentration of $N_2O_4$ in Anolyte was 20–25 wt. %)

| Run | No. of Cells | Coating/Substrate Anodes | Coating/Substrate Cathodes | Final Anolyte Concentrations, wt. % $N_2O_5$ | Final Anolyte Concentrations, wt. % $N_2O_4$ | Final Catholyte Concentrations, wt. % $N_2O_4$ | Final Catholyte Concentrations, wt. % $H_2O$ | Cell Voltages @ 100 A | Specific Energy kWg/kg |
|---|---|---|---|---|---|---|---|---|---|
| | | | | ICI Teflon Membranes | | | | | |
| 6 | 2 | $IrO_2$/Ti | $IrO_2$/Ti | 33 | 0.3 | 29 | 4.6 | 2.4, 2.7 | 1.2 |
| 12 | 2 | Pt/Nb<br>Pt—Ir/Nb | Pt/Nb<br>Pt/Nb | 20 | 1.4 | 23 | 7.1 | 6.3, 6.4 | 2.1 |
| | | | | Nafion Cation-Exchange Membrane (Type 117) | | | | | |
| 8 | 3 | $IrO_2$/Ti(2)<br>Pt/Nb | $IrO_2$/Ti(2)<br>Pt/Nb | 15 | 1.5 | 16 | 3.9 | 2.7, 2.8<br>3.3 | 1.1 |
| | | | | Raipore Anion Exchange Membranes | | | | | |
| 7 | 2 | $IrO_2$/Ti(2)<br>Pt/Nb | $IrO_2$/Ti<br>Pt/Nb | 26 | 3.3 | 37 | 15 | 2.1<br>2.7 | 1.0 |
| 9 | 3 | $IrO_2$/Ti(2)<br>Pt/Nb | $IrO_2$Ti(2)<br>Pt/Nb | 21 | 6.0 | 18 | 10.5 | 3.2, 3.2<br>4.2 | 1.6 |
| 10 | 3 | $IrO_2$/Ti(2)<br>Pt/Nb | $IrO_2$/Ti(2)<br>Pt/Nb | 27 | 1.4 | 20 | 4.7 | 3.6, 3.6<br>3.8 | 1.8 |
| 15 | 2 | $IrO_2$/Al<br>Pt—Ir/Nb | Pt/Nb<br>Pt/Nb | 26 | 2.2 | 30 | 12.8 | 3.3<br>4.4 | 1.7 |
| 16 | 2 | $IrO_2$/Al<br>Pt—Ir/Nb | Pt/Nb<br>Pt/Nb | 29 | 3.2 | 31 | 12.4 | 3.2<br>4.5 | 1.7 |

The volumes of anolyte product that were recovered are listed in Table 6:

TABLE 6

Volumes of Anolyte Recovered in the Dinitrogen Process Using the 0.1-$m^2$ Electrolyzer

| Run | Volume, gal. | Run | Volume, gal. |
|---|---|---|---|
| 6 | 2.3 | 10 | 2.4 |
| 7 | 3.1 | 12 | 2.4 |
| 8 | 1.5 | 15 | 3.2 |
| 9 | 3.5 | 16 | 2.7 |

Among the various characteristics of the electrosynthesis, the yield, current efficiency, and molar ratios depend almost exclusively on the type of membrane used; whereas the cell voltages depend primarily on cell geometry and the overpotential characteristics of the anode and cathode electrode coatings. The cell voltages and hence the specific energy of the process could be further reduced by electrolyzers of the "zero-gap" or minimum-gap type. In these designs, the anodes and cathodes are closer together than in the unit used in present examples. As expected, the characteristics exhibited by the porous Teflon diaphragm are similar to those observed with porous Vycor glass in the laboratory cell, since both are essentially neutral-pore separators. Both anolyte $N_2O_5$ and catholyte $H_2O$ yields are lower with the Nafion cation-exchange membrane, because this membrane is highly permeable to the cations $NO^+$ and $NO^{2+}$. These ions represent a large fraction of the $N_2O_4$ and the $N_2O_5$, respectively, that exist in the nitric acid solution. The preferred membrane in terms of yield of $N_2O_5$ based on $N_2O_4$ is the Raipore anion-exchange material, and it functions best because it is permeable principally to anions.

EXAMPLE 2

Electrolysis Using Larger Volumes And Different Electrodes

Using the 0.25-$m^2$ electrolyzer, several electrolyses were performed to demonstrate the process on a 3× larger scale and to test additional electrode coating/substrate materials. The starting solutions and process—control procedures were the same as those used for the 0.1-$m^2$ electrolyzer as described in Example 1. In the first electrolysis, the conditions and results were as follows:

Electrodes: Anodes: $IrO_2$/Al

Cathodes: Pt-Ir/Nb

Membranes: Raipore Anion Exchange R-4035, 6–7 mil

Maximum Current and Cell Voltage: 350 A and 4.2 V

Anolyte Recovered: 8.4 gal, 22.8 wt % $N_2O_5$ and 5.0 wt % $N_2O_4$ $N_2O_5$ Yield: 72%; Current Efficiency: 47%

Anolyte Vol. Change: −15%; F/$N_2O_4$: 3.1 $N_2O_5$/$N_2O_4$: 1.5

Specific Energy: 1.8 kWh/kg

In a second electrolysis experiment, the conditions and results were as follows:

Electrodes: Anodes and Cathodes: all Pt-Ir/Nb

Membranes: Raipore Anion Exchange R-4035, 6–7 mil

Maximum Current and Cell Voltage: 500 A and 5.0 V

Anolyte Recovered: 12.0 gal, 28.5 wt % $N_2O_5$ and 1.3 wt % $N_2O_4$

Current Efficiency: 50% Specific Energy: 2.2 kWh/kg

In a third electrolysis experiment, two batches of $N_2O_5$/$HNO_3$ were prepared using a new electrode coating/substrate combination for the anode in one of the cells, namely, Pt-Ir on aluminum. All cathodes and the other anodes were Pt-Ir/Nb. At approx. 20 wt % $N_2O_4$, and at an electrolyzer current of 500 A, the Pt-Ir/Al anode potential was +1.90 V vs. SCE and the cell voltage was 4.4 V, indicating excellent performance.

Based on the data given in Table 4 for the 0.1-$m^2$ electrolyzer, the data obtained as described above for the 0.25-$m^2$ electrolyzer, and other more detailed measurements of individual electrode potentials, the preferred anode coating (lowest overpotential, hence lowest cell voltage) was $IrO_2$, followed by Pt-Ir, then Series 7000 Pt, and least satisfactory, 11000 Pt. Although titanium metal was tested as a substrate because it is the industry standard in chlor-alkali electrolyzers, it is pyrophoric in the nitric acid media and therefore may constitute a safety hazard. Aluminum is the preferred metal substrate for the anodes, but niobium, which is more expensive, is also satisfactory. The preferred cathode coating is either 7,000 Pt or Pt-Ir on a substrate of niobium.

EXAMPLE 3

Recovery of $N_2O_4$ from the Catholyte

Simple, continuous vacuum distillation can be used to reprocess catholyte solutions and recover $N_2O_4$ for use as an anolyte feedstock. As an example, a 2-liter flask was charged with a simulated spent catholyte mixture consisting of 13.8 wt % $N_2O_4$, 10.9 wt % $H_2O$, and 75.3 wt % $HNO_3$. The flask was gently heated to a peak temperature of 49° C. at subatmospheric pressure, and vapor fractions were collected and frozen in removable sample bulbs. In four distillate samples the wt % concentration of $N_2O_4$ decreased from 63.3 to 22.2, the $HNO_3$ increased from 36.7 to 76.9, and the $H_2O$ increased from zero to 0.9. The combined distillate samples were 23.4 wt % of the initial mixture, and had a composite composition of 42.5 wt % $N_2O_4$, 0.3 wt % $H_2O$, and 57.2 wt % $HNO_3$. A total of 72.1 % of the original $N_2O_4$ was recovered in the combined overhead fraction.

Thus, it is shown that the method and electrolyzer of this invention is suitable for the production of anhydrous nitric acid and solutions of dinitrogen pentoxide in anhydrous nitric acid on a large, industrial scale.

The above embodiments were chosen and described in order to explain best the principles and the practical application of the subject invention thereby to enable those skilled in the art to utilize the invention in various other embodiments and various modifications as are suitable for the particular use contemplated. The foregoing description of a preferred embodiment of the invention has been presented therefore for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A process for the production of anhydrous nitric acid and a solution of dinitrogen pentoxide in nitric acid, and a concomitant process for producing solutions of dinitrogen tetroxide in nitric acid, the process comprising the steps of:

a) providing a plate-and-frame, flow through, divided-cell type electrolyzer, said electrolyzer being provided with an anode disposed in an anode compartment and a cathode disposed in a cathode compartment, said anode and said cathode compartments being separated by a plurality of separators, b) placing a solution of $N_2O_4$ in aqueous or anhydrous nitric acid in said anode compartment, c) placing aqueous or anhydrous nitric acid in said cathode compartment, d) applying a constant step-wise controlled current flow through said electrolyzer, e) vacuum distilling anhydrous $N_2O_4$ formed in the catholyte, f) recycling said $N_2O_4$ through said anode compartment as feed stock for said anode, and g) collecting anhydrous nitric acid and $N_2O_5$ formed in said anode compartment.

2. The method of claim 1, wherein said solution of $N_2O_4$ is an aqueous solution or a solution of $N_2O_4$ in anhydrous nitric acid.

3. The method of claim 1, further comprising continuously analyzing the solution in said cathode compartment for $N_2O_4$, $H_2O$ and $HNO_3$ and the solution in said anode compartment for $N_2O_4$, $H_2O$, $N_2O_5$ and $HNO_3$.

4. The method of claim 1, wherein said anode and said cathode comprise electrodes selected from the group consisting of $IrO_2$ coated on Al, platinum coated on niobium, a mixture of Pt or Ir coated on Al and a mixture of Pt or Ir coated on niobium.

5. The method of claim 3, wherein said separators are selected from the group consisting of porous hydrophilic teflon diaphragm, perfluorinated cation-exchange membrane and perfluorinated anion-exchange membrane.

6. A process for the simultaneous production of anhydrous nitric acid and a solution of dinitrogen pentoxide in nitric acid, and solutions of dinitrogen tetroxide in nitric acid, the process comprising the steps of:

a) providing a plate-and-frame, flow through, divided-cell type electrolyzer, said electrolyzer being provided with an anode disposed in an anode compartment and a cathode disposed in a cathode compartment, said anode and said cathode compartments being separated by a plurality of separators, b) placing an aqueous solution of $N_2O_4$ or a solution of $N_2O_4$ in anhydrous nitric acid in said anode compartment, c) placing aqueous or anhydrous nitric acid in said cathode compartment, d) applying a constant step-wise controlled current flow through said electrolyzer, e) vacuum distilling anhydrous $N_2O_4$ formed in the catholyte, f) recycling said $N_2O_4$ through said anode compartment as feed stock for said anode, and g) collecting anhydrous nitric acid and $N_2O_5$ formed in said anode compartment.

7. The method of claim 6, wherein said anode and said cathode comprise electrodes selected from the group consisting of $IrO_2$ coated on Al, platinum coated on niobium, a mixture of Pt or Ir coated on Al and a mixture of Pt or Ir coated on niobium.

8. The method of claim 7, wherein said separators are selected from the group consisting of porous hydrophilic teflon diaphragm, perfluorinated cation-exchange membrane and perfluorinated anion-exchange membrane.

* * * * *